US011815003B1

(12) United States Patent
Medam

(10) Patent No.: US 11,815,003 B1
(45) Date of Patent: Nov. 14, 2023

(54) SYSTEM AND METHOD FOR MONITORING COOLANT SYSTEM INTEGRITY IN ENGINES

(71) Applicant: International Engine Intellectual Property Company, LLC, Lisle, IL (US)

(72) Inventor: Krishna Teja Medam, Naperville, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 0 days.

(21) Appl. No.: 17/859,405

(22) Filed: Jul. 7, 2022

(51) Int. Cl.
*F01P 11/18* (2006.01)
*F01P 3/18* (2006.01)
*F01P 3/20* (2006.01)

(52) U.S. Cl.
CPC ..... *F01P 11/18* (2013.01); *F01P 3/18* (2013.01); *F01P 3/20* (2013.01); *F01P 2025/04* (2013.01)

(58) Field of Classification Search
CPC ..... F01P 11/18; F01P 3/18; F01P 3/20; F01P 11/16; F01P 11/14; F01P 2025/04
See application file for complete search history.

(56) References Cited

U.S. PATENT DOCUMENTS

2018/0073423 A1* 3/2018 Speichinger ..... G01M 15/048

* cited by examiner

*Primary Examiner* — Jacob M Amick
(74) *Attorney, Agent, or Firm* — Mark C. Bach; Umang Khanna

(57) ABSTRACT

The present disclosure relates to improved systems and methods for use in connection with maintaining the coolant system of a vehicle. Specifically, the present disclosure relates to improved systems and methods for monitoring the integrity of the coolant system in an engine, including capabilities for diagnosing leaks, degradation of coolant, open and/or loose radiator caps, and other sources of potential malfunctions. Early diagnosis and continuous monitoring of an engine coolant system results in earlier repairs and less vehicle downtime.

17 Claims, 5 Drawing Sheets

SYSTEM AND METHOD FOR MONITORING COOLANT SYSTEM INTEGRITY IN ENGINES

TECHNICAL FIELD

The present disclosure relates to systems and methods for use in connection with maintaining the coolant system of a vehicle. Specifically, the present disclosure relates to improved systems and methods for monitoring the integrity of the coolant system in an engine, including capabilities for diagnosing leaks, degradation of coolant, open and/or loose radiator caps, and other potential malfunctions. The present system and method are configured to pinpoint the cause of coolant system issues and/or failures, providing an accurate diagnosis and initiation of any necessary repairs.

BACKGROUND

Engine cooling systems are conventional components in all vehicles, including standard passenger automobiles to heavy duty diesel engines. If heat is not removed from an engine, engine internal temperatures would soon reach a point of component damage and engine failure. Properly functioning engine cooling systems are designed to absorb this heat and transfer it to a heat absorbing medium outside of the engine.

Specifically, liquid cooling systems transfer waste heat out of the block and internals of the engine. The cooling system consists of a closed loop and typically contains the following major components: water pump, radiator or heat exchanger having a pressure-release cap, a water jacket consisting of coolant passages in the block and cylinders for receiving the cooling liquid, a fan which draws in air through the radiator to cool the water/coolant liquid, and a thermostat. The coolant is also typically routed through a heater core to provide heat for the vehicle passenger compartment, when needed, as well as being routed through an exhaust gas recirculation (EGR) cooler.

Maintenance of the coolant system is critical for proper operation of the vehicle. For example, during the process of performing rationality monitoring for coolant pressure in a heavy-duty diesel engine for highway and off-highway semi-trucks, it is difficult to know if the radiator pressure cap is tightly closed and/or open, or if there are any leaks in the coolant system without having an additional hardware component that can indicate the status to an engine control module. Failure to properly replace the pressure-release cap after flushing maintenance for example, and leaks in the coolant system, can lead to performance issues and failure of a vehicle, in turn leading to costly downtime. However, in the situation of refill of the coolant within the system, there is currently no indicator of an open and/or loose cap after completion. Having an indicator of an open and/or loose cap would avoid potentially costly malfunctions of the coolant system.

There is also no continuous monitoring of a coolant pressure sensor to diagnose coolant system errors and/or leaks. During maintenance, after the coolant is drawn out completely and re-filled, de-aeration should be performed to remove any air trapped in the coolant circuit system by running water pump at full speed. A detection system and method are further needed to detect the proper refill of the coolant within the coolant system, and/or to indicate if the cap is removed or in place.

Therefore, a need exists for improved diagnostic/monitoring systems and methods for use in connection with the coolant system of a vehicle. Specifically, a need exists for improved systems and methods for monitoring the integrity of the coolant system in an engine for diagnosing potential faults such as leaks within the coolant system circuit.

A need further exists for improved diagnostic systems and methods to monitor whether the radiator cap is open, missing and/or loose.

Yet another need exists for improved diagnostic systems and methods to monitor degradation of the coolant, which can subsequently affect engine performance.

A need also exists for improved diagnostic systems and methods to pinpoint the cause of coolant system issues so an accurate diagnosis and any necessary repairs can be immediately initiated, thereby saving on vehicle downtime and costs.

SUMMARY

The present disclosure relates to improved systems and methods for use in connection with maintaining the coolant system of a vehicle. Specifically, the present disclosure relates to improved systems and methods for monitoring the integrity of the coolant system in an engine, including providing diagnostic capabilities for determining leaks, degradation of coolant, open, missing and/or loose radiator caps, as well as other possible issues or malfunctions relating to the coolant system. The present systems and methods also pinpoint the cause of coolant system issues, thereby providing an accurate diagnosis so any necessary repairs can be quickly and easily initiated. Monitoring the coolant system and identifying the root cause of any problems within the coolant system reduces redundant fault occurrences and increases the uptime operation of the vehicle.

To this end, in an embodiment of the present disclosure, a method of monitoring a coolant system for a vehicle is provided. The method comprises the steps of providing at least one sensor positioned within the coolant system, connecting the sensor with at least one onboard diagnostic module within the vehicle, automatically monitoring changes and or faults within the coolant system through the sensor; and, transmitting the changes and/or faults within the coolant system from the sensor to the onboard diagnostic module.

In another embodiment, a diagnostic system for monitoring a coolant system in a vehicle is provided. The system comprises at least one sensor positioned within the coolant system of the vehicle, at least one onboard diagnostic module located within vehicle and in communication with the sensor; and wherein the sensor is configured to monitor changes in liquid pressure readings within the coolant system and transmit the changes to the onboard diagnostic module.

In yet another embodiment, a diagnostic system for detecting a coolant system failure within a coolant system, is provided. The system comprises at least one sensor incorporated into the coolant system, at least one onboard diagnostic module in communication with the sensor, wherein the sensor is configured to monitor changes in the liquid pressures within the coolant system and transmit the changes to the onboard diagnostic module, and wherein the onboard diagnostic module is configured to provide an error reading based on changes in the liquid pressures.

It is, therefore, an advantage and objective of the present disclosure to provide diagnostic system for monitoring a coolant system in a vehicle. The present disclosure provides diagnostic capabilities relating to determining leaks, degradation of coolant, open and/or loose radiator caps, as well as other possible malfunctions of the coolant system and vehicle operation.

It is a further advantage and objective of the present disclosure to provide diagnostic systems and methods wherein any potential issues within the coolant system can be quickly identified, thereby providing an accurate diagnosis so that any necessary repairs can be quickly and easily addressed.

Yet another advantage and objective of the present disclosure is utilization of software and calibration comparisons within the diagnostic system to continuously monitor and detect potential faults within the coolant system, thereby providing a cost advantage over incorporating additional diagnostic hardware components into the engine.

Additional features and advantages of the present disclosure are described in, and will be apparent from, the detailed description of the present embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The present disclosure relates to improved systems and methods for use in connection with diagnosis and maintenance of a coolant system of a vehicle. Specifically, the present disclosure relates to improved systems and methods for monitoring the integrity of the coolant system in an engine, including diagnosing leaks, degradation of coolant, open and/or loose radiator caps, as well as other possible issues relating to the coolant system. The present systems and methods pinpoint the cause of coolant system issues and malfunctions, thereby providing an accurate diagnosis so any necessary repairs can be initiated. Monitoring the coolant system and pinpointing the root cause of any problems reduces redundant fault occurrences and increases the uptime operation of the vehicle.

The present system and method utilize the physics involved in a closed loop pressure dynamics system to monitor the coolant pressure in a vehicle, including heavy-duty diesel engines and passenger vehicles. Under ideal gas law, pressure is directly proportional to temperature assuming no leaks in the system, no changes in the coolant volume and volume of space in the coolant system circuit. Volume of space available in the coolant system circuit will never change unless the hardware of the engine is changed. Assuming no leaks, volume of the coolant remains the same, and as the engine is running, the coolant temperature and pressure increases.

There is a limit on the pressure that the radiator cap can handle and once that pressure is exceeded, the radiator cap pops out and pressure drops instantly to atmospheric pressure. This sudden drop will indicate the cap is open, and system monitoring cannot be performed. When the circuit is closed, the pressure is directly dependent on the temperature of the engine and follows a trend. This unique trend incorporated in the present system and method is useful for detecting leaks in the coolant system circuit. When there are leaks and/or incorrect or loose cap setting, pressure builds up to a limit and then drops closer to atmospheric pressure. This drop in pressure indicates the coolant system circuit needs diagnosis to continue monitoring.

According to the present disclosure, under certain conditions, the coolant pressure and coolant level can be used to detect coolant refill, i.e., by detecting the sudden pressure drop when the radiator cap is opened, loose and/or missing. Additionally, the present system and method detects whether deaeration of the coolant system is needed once coolant is emptied and refilled to remove any trapped air within the coolant system circuit. The present disclosure also provides cost-savings advantages in that it utilizes software and pressure/temperature calibration comparisons for the monitoring and diagnosis system. Thus, the present system and method avoids the requirement for additional costly hardware that would otherwise be needed to diagnosis and monitoring of the coolant system.

Figure 1:
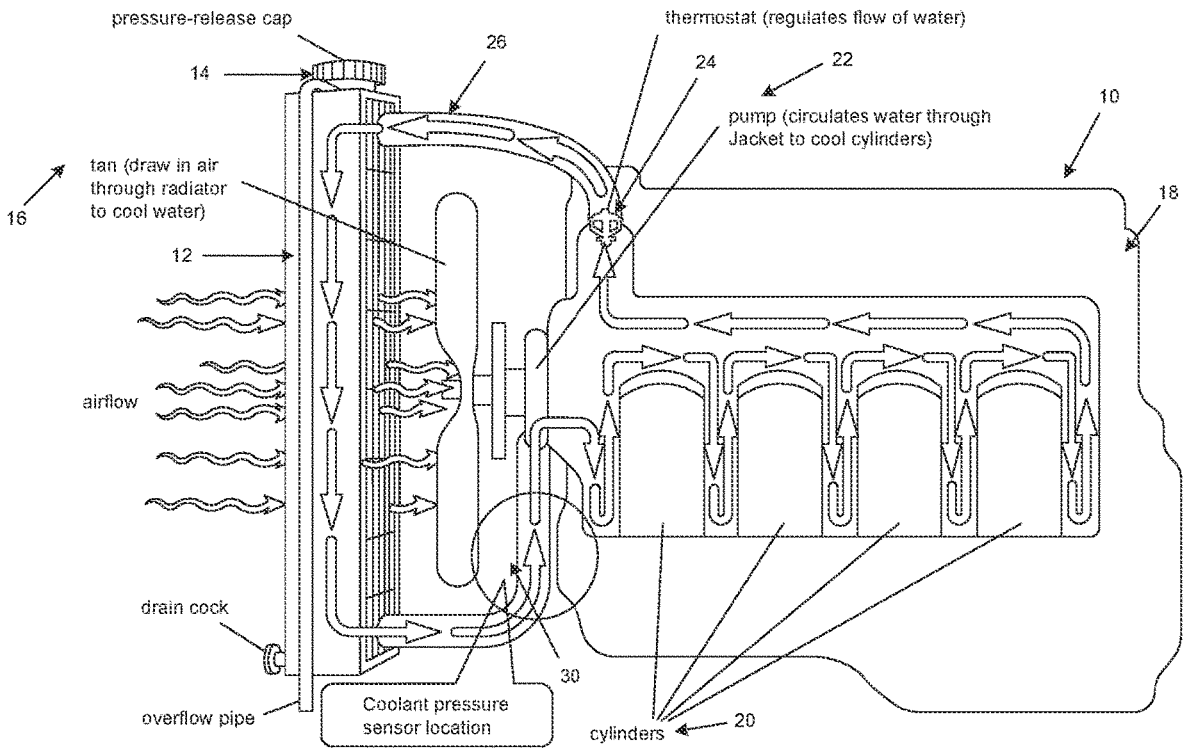
FIG. 1 illustrates a diagram of an example of a generally known coolant system circuit for a vehicle incorporating a diagnostic sensor of the present disclosure.
Figure 2:
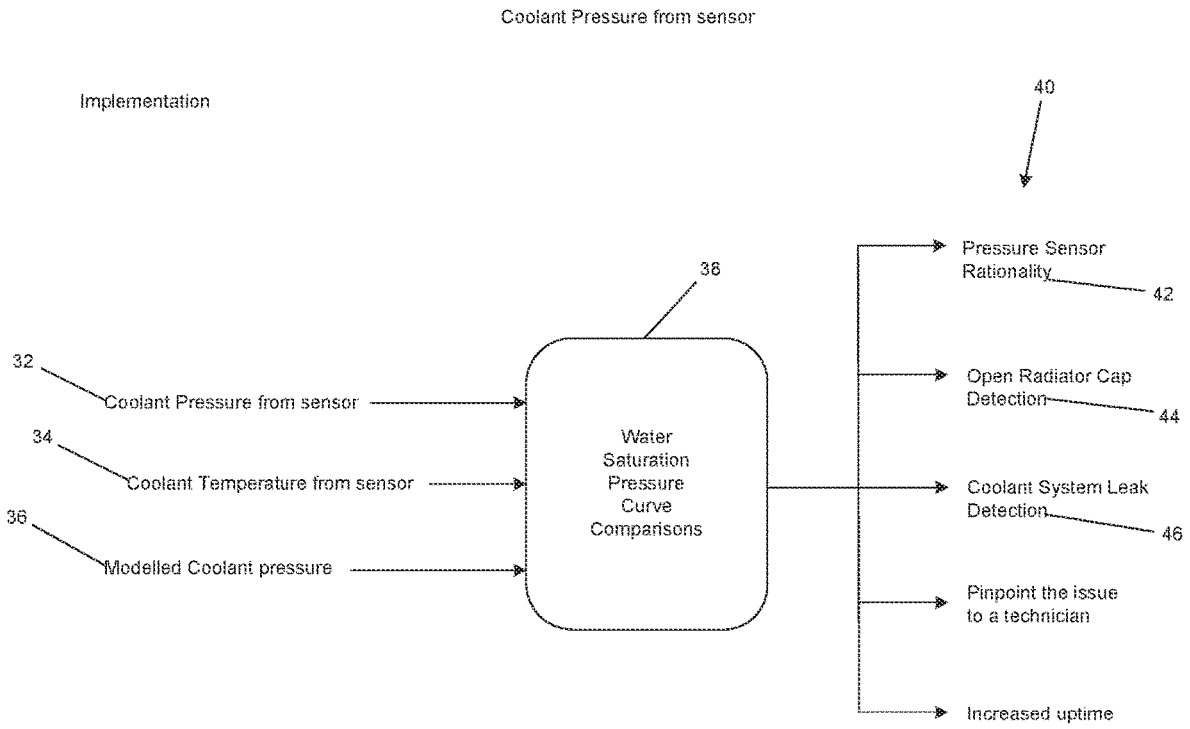
FIG. 2 illustrates a schematic diagram showing implementation of the present diagnostic system and method according to the present disclosure.
Figure 3:
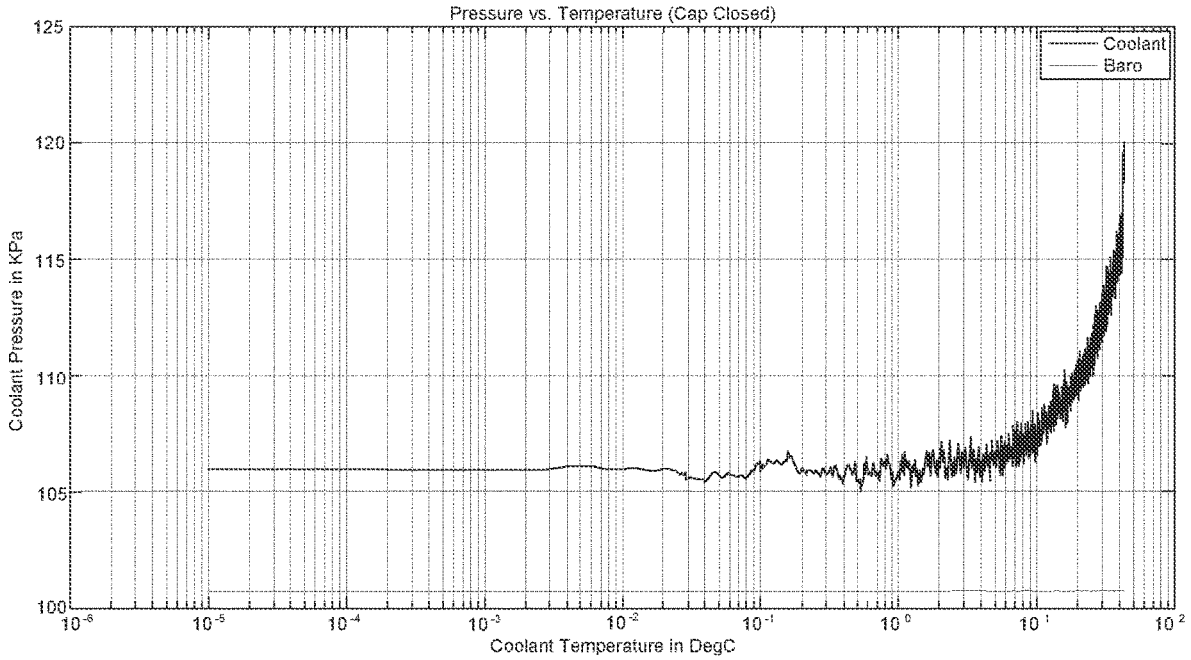
FIG. 3 illustrates a standard coolant pressure graph representation when the radiator cap is closed and the coolant system is functioning properly.
Figure 4:
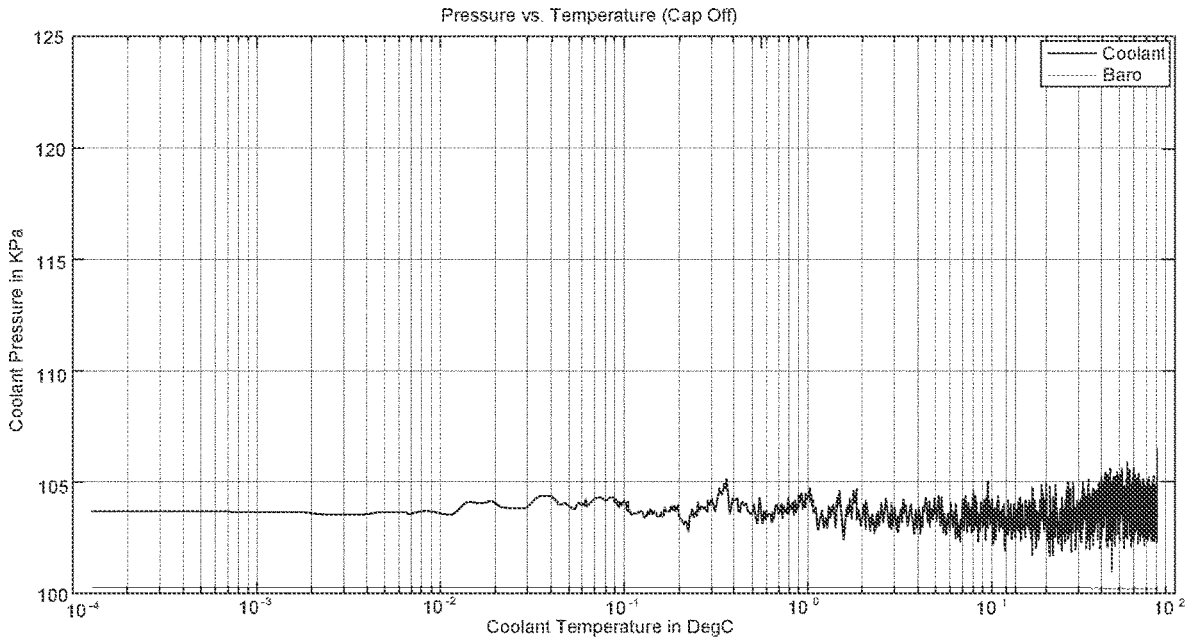
FIG. 4 illustrates a graphic representation of a change in the coolant pressure profile of the coolant system when the radiator cap is off; and, FIG. 5 illustrates a graphic representation of a change in the coolant pressure profile of the coolant system when the radiator cap is loose.
Figure 5:
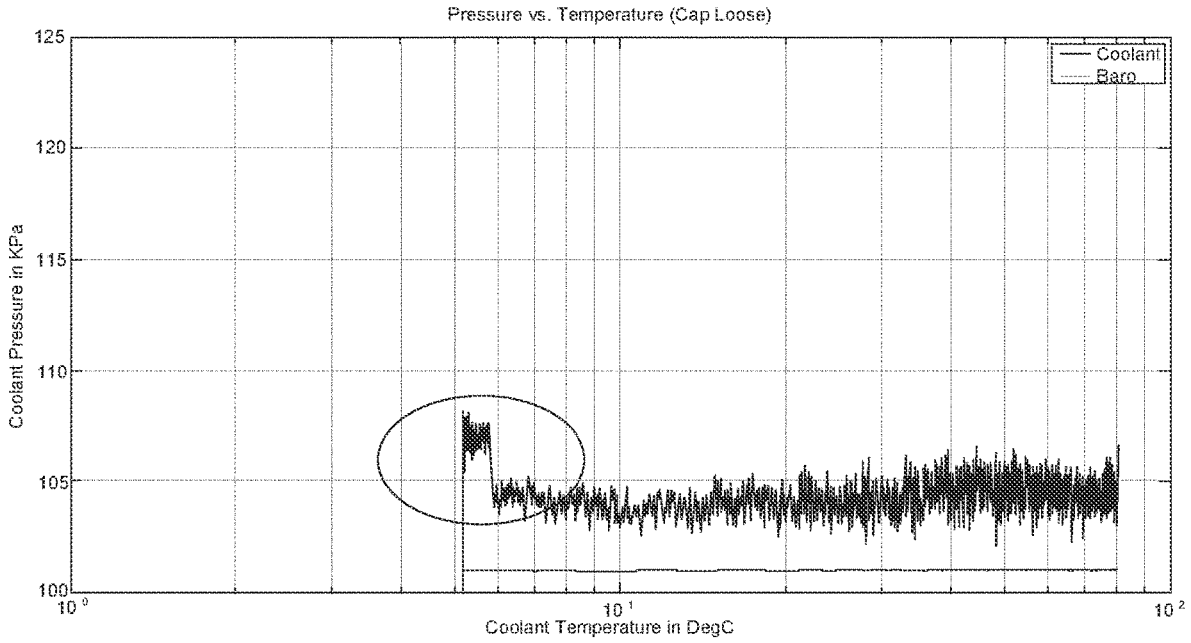

Now referring to the figures, wherein like numerals refer to like parts, FIG. 1 illustrates a diagram of a generally known coolant system for use in a vehicle. FIG. 2 a schematic diagram showing implementation of the present diagnostic system and method according to the present disclosure. FIG. 3 illustrates a standard coolant pressure profile graph when the radiator cap is closed and the system is functioning properly. FIGS. 4 and 5 illustrate the changes in the coolant pressure profile when the radiator cap is off (FIG. 4) or loose (FIG. 5).

Coolant systems in vehicles, from heavy duty diesel engines to typical passenger vehicles are well-known. FIG. 1 illustrates an example of a generally known coolant system 10 for a vehicle. Some of the standard components of the coolant system 10 include: a radiator 12 having a pressure-release cap or radiator cap 14, a fan 16 which draws air through the radiator to enhance the cooling effect into the jacket 18, which contains the cylinders 20. Connected behind the fan 16 is a pump 22 which circulates liquid coolant through the system. A thermostat 24 regulates the flow of liquid from the jacket 18. The components of the coolant system 10 are interconnected as a closed loop through a series of tubing 26, which circulates the cooling liquid through the components of the coolant system.

Because the coolant system is a closed system, it is difficult to properly monitor the system for changes without the addition of costly hardware components typically used to indicate the status of the system to an engine control module. For example, it is generally difficult to know if the radiator cap 14 is tightly closed, open or loose, or if there are any leaks in the coolant tubing or piping components until the fault leads to a failure. Additionally, when service is performed on the coolant system 10 wherein the liquid coolant is completely removed from the system and re-filled, deaeration should be performed to remove any air trapped within the coolant circuit. Therefore, it would be useful to incorporate a monitoring and detection system that does not require costly hardware components to determine these changes within the coolant system during operation or after service.

The present disclosure overcomes these issues by incorporating and utilizing at least one sensor 30 within the coolant system 10 (FIG. 1). FIG. 2 is a flowchart demonstrating the proposed monitoring and diagnostic method of the present disclosure. In the process of monitoring the coolant system 10 of a particular vehicle, the sensor 30 gathers the readings of coolant pressure 32 and coolant temperature 34 of the vehicle coolant system. Using software incorporated into the coolant system sensor 30, the two readings 32, 34 are compared to standard coolant pressure readings 36, thereby generating pressure versus temperature curve readings 38 based on the comparisons. Under conditions of ideal gas law, pressure is directly proportional to temperature, assuming no leaks in the coolant system, no changes in the coolant liquid volume. Thus, the behavior of coolant pressure profile is predictable and useful in the monitoring/diagnosis method of the present disclosure, because when there is a leak or a radiator cap failure, the pressure versus temperature behavior profile deviates from the standard behavior.

For example, FIG. 3 demonstrates the pressure versus temperature curve when the radiator cap 14 is closed and the coolant system 10 is operating properly. In contrast, FIG. 4 shows the pressure versus temperature gradient readings when the radiator cap 14 is off, while FIG. 5 illustrates the pressure versus temperature gradient readings when the radiator cap 14 is loose. Similar gradient readings will be generated when there is a leak in the system as well.

Software incorporated into the coolant system 10 generates fault readings or fault indicators 40 based on the pressure versus temperature gradient readings to create a variety of fault indicators 40 (FIG. 2). These fault or malfunction indicators may include: "Pressure Sensor Rationality 42," "Radiator Cap Open 44," "Coolant Leak 46," etc. It should be noted that any variety of fault indicators 40 can be created for a specific system. The fault indicators 40 are transmitted to an engine control module (not shown), where the fault indicators for a radiator cap 14 malfunction or a coolant leak in the coolant system 10 can be easily read by a driver. The fault indicators 40 also serve to identify a malfunction within the coolant system 10, which then can be easily located and addressed by a repair technician.

The present diagnostic and monitoring system provides the advantages of early detection of coolant system leaks, degradation of the coolant liquid, open/loose radiator caps, air trapped within the coolant system after a flush and refill, all of which can lead to vehicle malfunction and operation downtime. Early and accurate detection of these faults and malfunctions leads to quicker repairs and less vehicle operational downtime.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A method of monitoring a coolant system within a vehicle, the method comprising the steps of:

providing at least one sensor positioned within the coolant system;

providing a plurality of liquid saturation pressure curve standards and storing the standards within at least one onboard diagnostic module;

connecting the sensor with the at least one onboard diagnostic module within the vehicle;

automatically monitoring faults within the coolant system through the sensor; and, transmitting the faults within the coolant system to the onboard diagnostic module.

2. The method of claim 1, wherein at least one sensor monitors the changes in coolant pressure as a function of temperature.

3. The method of claim 2, wherein the method further includes monitoring the coolant pressure through closed loop pressure dynamics readings.

4. The method of claim 3, wherein the method further includes comparing the coolant pressure readings from the at least one sensor to the saturation pressure curve standards and determining anomalies within the coolant system.

5. The method of claim 4, wherein the method further includes transmitting changes in the coolant pressure compared to the saturation pressure curve standards to the onboard diagnostic module.

6. The method of claim 5, wherein the method further includes providing error messages generated by the changes in the coolant pressure on the onboard diagnostic module.

7. The method of claim 6, wherein the method further includes diagnosis of malfunctions within the coolant system presented by the error messages.

8. The method of claim 7, wherein the error messages pinpoint the malfunctions within the coolant system.

9. A diagnostic system for monitoring a coolant system in a vehicle, the system comprising:

at least one sensor positioned within the coolant system within the vehicle;

at least one onboard diagnostic module located within vehicle and in communication with the sensor; wherein the onboard diagnostic module contains a plurality of liquid saturation pressure standards useful for comparison with the liquid pressure readings from the sensor; and wherein the sensor is configured to monitor changes in liquid pressure and temperature readings within the coolant system and transmit the changes to the onboard diagnostic module.

10. The diagnostic system of claim 9, wherein changes in the liquid pressure readings from the sensor when compared to the liquid saturation pressure standards identifies potential anomalies in coolant pressure within the coolant system.

11. The diagnostic system of claim 10, wherein the anomalies in the coolant pressure transmit as a diagnostic fault to the onboard diagnostic module.

12. The diagnostic system of claim 11, wherein the onboard diagnostic module displays the diagnostic fault as a readable message.

13. The diagnostic system of claim 12, wherein the diagnostic fault message identifies a source of the anomaly within the coolant system.

14. The diagnostic system of claim 13, wherein the diagnostic fault message reports an anomaly including a coolant leak.

15. The diagnostic system of claim 14 wherein the diagnostic fault message reports an anomaly including an open and/or loose radiator cap.

16. A diagnostic system for detecting a coolant system failure within a coolant system, the system comprising:

at least one sensor within the coolant system;

at least one onboard diagnostic module in communication with the sensor;

wherein the sensor is configured to continuously monitor changes in the liquid pressures within the coolant system and transmit the changes to the onboard diagnostic module; and wherein the onboard diagnostic module is configured to provide an error reading based on changes in the liquid pressures by comparing the readings from the sensor to standard coolant liquid saturation pressures stored in the onboard diagnostic module.

17. The diagnostic system of claim 16 wherein the comparison readings identify a malfunction within the coolant system.

* * * * *